US005351640A

United States Patent [19]

Attaway et al.

[11] Patent Number: 5,351,640

[45] Date of Patent: Oct. 4, 1994

[54] PORTABLE MANUAL BOAT HULL CLEANER

[76] Inventors: Robert V. Attaway; Charles E. Rodgers, Jr., both of 544 Plasters Ave., NE., Atlanta, Ga. 30324

[21] Appl. No.: 110,500

[22] Filed: Aug. 23, 1993

Related U.S. Application Data

[63] Continuation of Ser. No. 839,486, Feb. 20, 1992, abandoned.

[51] Int. Cl.[5] ..... B63B 59/00

[52] U.S. Cl. ..... 114/222

[58] Field of Search ..... 114/221, 222; 15/1.7, 15/210 R, 222, 209 C

[56] References Cited

U.S. PATENT DOCUMENTS 834,399 10/1906 McLellan ..... 114/222

4,150,458 4/1929 Compere ..... 15/222

4,204,494 5/1980 Bridwell et al. ..... 114/222

4,395,966 8/1983 Murphy ..... 114/222

4,512,054 4/1985 Clark ..... 15/222

*Primary Examiner*—Edwin L. Swinehart

*Attorney, Agent, or Firm*—Jones & Askew

[57] ABSTRACT

A portable manual boat hull cleaner is disclosed in which a plurality of cleaning loops are attached to a strap having handles at either end, said cleaning loops comprising support pads sandwiched between a strap and a detachable scrubbing pad by two anchor flaps. The cleaning loops are placed at regular intervals along the length of the strap. The entire cleaning device may be placed beneath the hull of a boat and moved back and forth in the manner of a shoe shine rag to remove marine growth from the submerged surface of a boat hull.

21 Claims, 4 Drawing Sheets

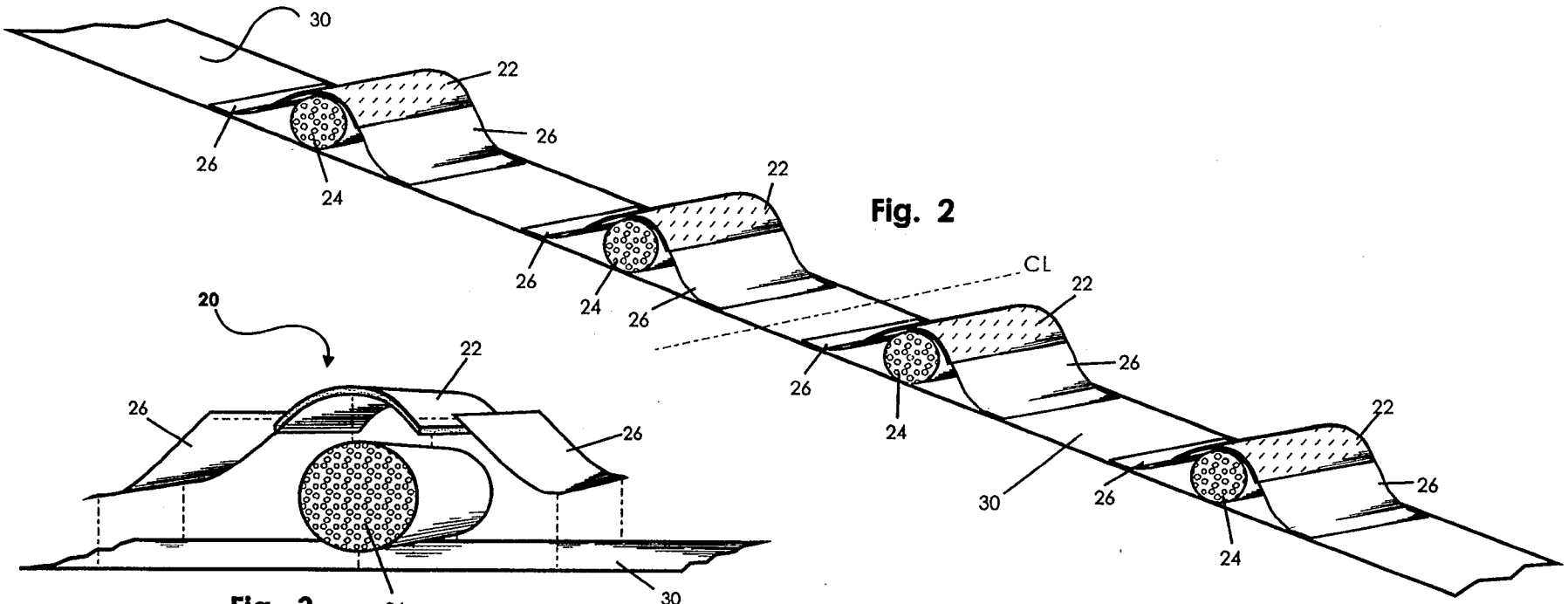
Fig. 2
Fig. 3
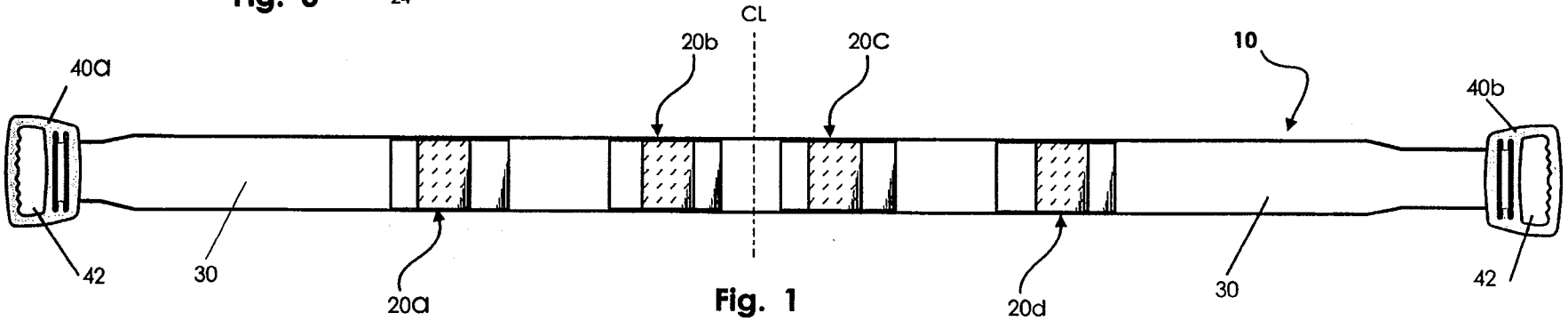
Fig. 1

Fig. 6
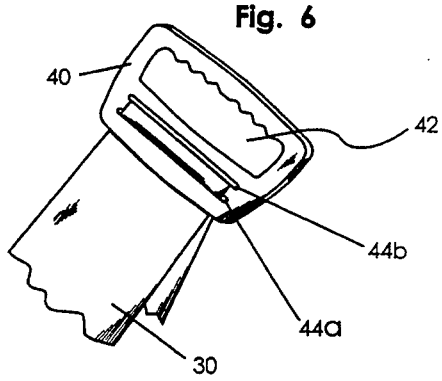
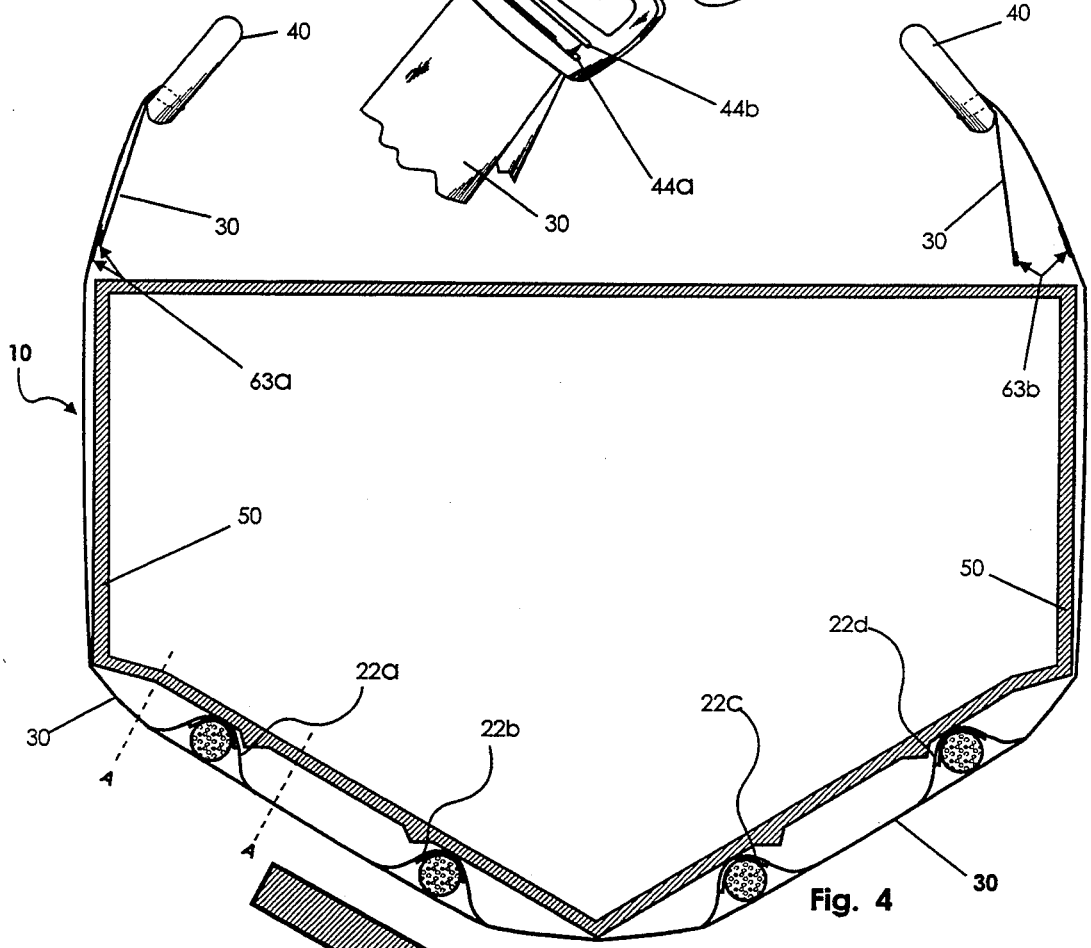
Fig. 4
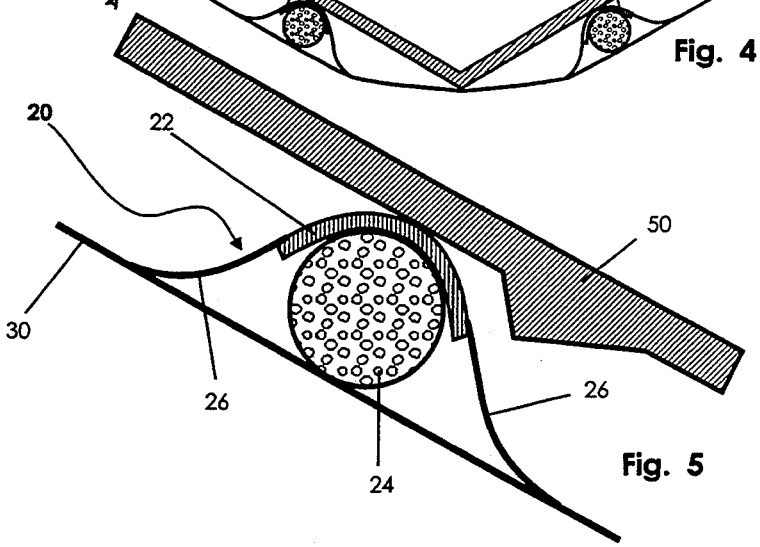
Fig. 5

PORTABLE MANUAL BOAT HULL CLEANER

This is a continuation of application Ser. No. 07/839,486, filed Feb. 20, 1992, now abandoned.

TECHNICAL FIELD

The present invention relates to a device and method for cleaning submerged surfaces and, more particularly, relates to a device and method for removing a variety of fouling agents including algae, barnacles and other forms of marine growth from the submerged surfaces of fiberglass or wood boat hulls.

BACKGROUND OF THE INVENTION

Boats, floating docks and other structures which remain relatively immobile and partially submerged beneath the surface of a body of water, whether salt water or fresh water, commonly accumulate a coating of material such as dirt and slime on their submerged surfaces. This coating is the result of a variety of fouling agents, but is predominantly caused by marine growth.

Among the marine life forms responsible for fouling boat hulls is the barnacle. Barnacles are totally sessile and most live attached to docks, shells, rocks, boat hulls and other submerged surfaces. When a boat is docked or anchored and immobile. barnacles are able to attach themselves to a boat's bottom when in the larval stage by secreting a cement like substance. Once the "cement" hardens, the barnacle becomes permanently attached to the boat hull and is extremely difficult to remove without damage to the hull's surface. Barnacles are particularly damaging to soft hull finishes, such as the gel coat normally present on fiberglass hulls. Although less damaging to the surface of the boat hull, algae and other marine organisms are also significant contributors to fouling.

The accumulation of marine growth and other fouling agents on a boat hull has a number of adverse consequences including significant increases in the cost of maintaining and operating a vessel. As described above, marine growth can cause extensive damage to paints, gel coats, and other substances used to treat and finish boat hulls. An accumulation of marine growth contributes to the process of osmotic blistering whereby the paint or gel coat on the submerged surface of the boat develops blisters and eventually forms pox exposing the hull to the environment. The hull surface must then be refinished. Also, the accumulation of marine growth on a boat hull has a marked effect on speed and fuel consumption. Barnacles can form encrustaceans on boat hulls that can reduce a boat's speed by 30% and cause a significant increase in fuel costs. Barnes, R. D., *Invertebrate Zoology,* 3d. ed. (1974). Algal growth has a similar effect on fuel consumption and speed.

Maintaining a clean hull surface will prolong the life of a boat and reduce the need for more expensive maintenance procedures. An effective method for removing fouling agents is to scrub the hull surface by hand; however, manually cleaning a boat hull is laborious, time consuming and inefficient.

The most effective way to clean a hull surface manually is to raise the boat from the water and then scrub the hull. Raising a boat from the water normally requires the availability of a lift and the opportunity to schedule use of the lift. This presupposes the proximity of a boat yard with a lift facility. It also requires the availability of space in the yard at which the vessel can be stored while the bottom cleaning takes place. Many boaters store their boats at marinas, private docks, or other locations which are not near boat yard facilities with lifts. Thus, hull cleaning in this fashion tends to be done at relatively long intervals between cleanings. This makes preventative maintenance, i.e., regular cleaning before the hull growth becomes problematic, unavailable as a practical matter.

The hull can also be cleaned manually by entering the water to scrub the hull but this method also has a number of difficulties associated therewith. First and foremost, it is often difficult to obtain any kind of purchase on the hull since the more the cleaner pushes on the hull in order to apply friction thereto, the more the cleaner is pushed away from the surface of the hull. Thus, it can get very tiring to be constantly propelling oneself, usually with the legs, in order to engage the surface of the boat. This can sometimes be alleviated by pushing off from the side of a dock or a dock piling. However, under many conditions of tidal flow and wave action, it is dangerous for a person to be in the water in the space between a boat and a dock because movement of the vessel toward the dock can pin the individual therebetween. Additionally, if the user is successful in pushing off on a dock piling or similar structure in order to obtain purchase on the boat hull, it is inconvenient and time consuming to have to reverse the position of the vessel between port alongside and starboard alongside in order to clean both sides of the hull. While it is possible to rig arrangements of ropes and the like which the individual in the water cleaning the hull can hold, these arrangements are cumbersome.

Entering the water to clean a boat hull presents a variety of other hazards as well. For example, in some areas of the United States it is illegal to enter the water around boat docks because of the risk of electrocution caused by cables in the water supplying shore power. In many instances it is unwise, even if legal. Additionally, as anyone who has ever cleaned a boat hull in the water knows, cleaning a reasonably fouled hull quickly leads to the act of swimming in murky and relatively unpleasant water. While it is customary to wear a diving mask during this activity, it can still become very difficult to see other parts of the hull and to continue the work because the loosened debris clouds the adjacent water. Naturally, if there are sufficient tidal currents or other water flow present to quickly remove this debris, it is difficult for the individual doing the cleaning to stay in the vicinity of the boat.

The fact that boats with overly developed bottom growths are virtually ubiquitous, particularly in the warmer climates of the southern United States, is testimony to the extent to which boaters will delay addressing the problem of bottom growth due to its significant inconvenience and expense. Furthermore, it should be noted that the difficulty of a bottom cleaning job increases geometrically with the time between cleanings. In other words, when the boat is allowed to sit twice as long under the same conditions, the cleaning job is normally more than twice as difficult and problematic. In particular, if a well developed set of barnacles gets attached to a hull, the removal of the barnacles will almost invariably damage the gel coat or varnish, whereas relatively easy regular cleaning at more closely spaced regular intervals could prevent the attachment of the barnacles to the hull in the first place, thus preventing damage to its finish.

To make the process of maintaining a clean hull more efficient and less laborious, a variety of different methods and mechanical devices have been developed which either prevent the accumulation of algae and barnacles or remove them from a boat's surface after accumulation. These devices and methods cause other problems in many instances and have been met with limited acceptance or have limited utility.

For example, one method currently available to prevent algal growth and the accumulation of barnacles on boat hulls is the application of a paint which contains a biocidal agent. Typically, this paint dissolves over time exposing fresh biocide on the surface of the hull. Generally, the paint lasts only a few seasons and must be reapplied. One advantage of this method is that the surface of the paint becomes smoother as the paint dissolves, as opposed to other paints which tend to blister and develop pox. The disadvantage is that the biocidal paints are expensive and that this particular method requires that the boat be dry docked for prolonged periods of time to repaint its surface. Additional problems of environmental and regulatory nature also result: from the use of biocidal paints. Some jurisdictions are outlawing their use in inland waters and there is concern that leeching of biocides in coastal areas near wetlands can damage oyster beds and shrimp spawning grounds.

A variety of mechanical boat hull cleaning devices have been designed to ease the task of hull maintenance. U.S. Pat. No. 4,204,494 to Bridwell et al. discloses a boat washing apparatus having a stationary frame to which are pivoted a pair of carrier frames with journal rotary power driven brushes across which an elevated boat mounted on a support may be moved. Although the device disclosed by Bridwell et al. is commonly used and considered to be effective for removing marine growth, it requires a professional operator. As with manual cleaning, it also requires that the boat be lifted from the water and to the place where the cleaning device is located. This is an expensive and time consuming process that is suitable for periodic major cleaning but is impractical for keeping the hull continually free of marine growth.

A hull cleaning device which does not require that a boat be removed from the water is disclosed in U.S. Pat. No. 4.395,966 to Murphy. Murphy discloses a boat hull scrubber which allows the boat to remain afloat and the person cleaning the boat to remain aboard. This makes it possible to clean the boat in open water. Murphy discloses a boat hull scrubber comprising a one piece belt of fibrous abrasive material with a plurality of floats mounted along the undersurface of the belt such that the floats pivot at fight angles to the belt. The hull cleaner is designed such that the floats urge the belt into contact with the hull of the boat when the cleaning strap is drawn beneath the boat. As the operators on the deck of the boat pull either end of the cleaning strap, the strap is forced into frictional contact with boat hull.

In practice, the device disclosed in the patent to Murphy has several deficiencies. For one, the large number of floats attached to the full length cleaning pad and necessary to keep the cleaning pad afloat, occupy significant storage space on board a vessel. This makes it impractical to travel with the scrubber or to stow it on board. On most recreational boats, storage space is scarce and a bulky rarely used item, particularly one which is not a piece of essential safety equipment, will rarely be stowed on board. The great number of floats needed to keep the cleaning pad afloat also makes it difficult to pull the floats and pad beneath the surface of the water and to position them beneath the hull of the boat. Furthermore, the relatively large buoyancy of this device can cause it to creep toward the bow of the boat when trying to clean the sloped portion of the hull between the bow and the keel. In other words, the device is hard to get under the boat and difficult to control.

The Murphy patent exhibits several other deficiencies as well. For example, the force required to to pull the scrubbing pad back and forth across the hull tends to create tension along the length of the scrubbing pad. This tension counteracts the intended upward pressure of the floats and causes the scrubbing pad to pull away from the surface of the hull. Thus, the effectiveness of the device is reduced. Additionally, because the Murphy hull scrubber uses a full length scrubbing belt, the friction created between the scrubbing belt and the hull of the boat makes it difficult to move the device. It requires a great amount of energy, causing the individuals operating the device to tire quickly. The friction created along the length of the pad may also cause the boat to roll from side to side as the operators go through the scrubbing motion, tending to put the scrubbing individuals in the water. Finally, the Murphy device is not adaptable to different marine environments because the cleaning pad itself is an integral and permanent pan of the device. This eliminates the possibility of using alternate or replacement cleaning pads. If the belt is damaged or the cleaning pad is worn, the entire device must be replaced.

A variety of simpler and inexpensive mechanical boat cleaning devices have been developed and abound on the market. For example, currently on the market is a device which comprises a scrubbing pad attached to the end of a pole which may be extended into the water by a person standing on a dock. The person then scrubs up and down in an attempt to remove the marine growth. This technique is not particularly effective because it is difficult to apply sufficient pressure to remove the marine growth. Additionally, it does not allow access to all sides of the boat and does not allow the scrubber to reach the underside of the hull. Generally, the methods and devices currently available have limited utility and fail to solve the problems in the art.

Thus, what is needed in the art is a boat hull cleaning device which is relatively inexpensive, portable and compact; which can be operated by the boat owner; and which allows the operators to remain on board and the boat afloat during the cleaning process.

SUMMARY OF THE INVENTION

The present invention solves these problems in the art by providing a device for removing marine growth and other fouling agents from the submerged surface of a boat hull which can be operated while the boat is afloat and the operators are on board the vessel. The device of the present invention is particularly suited to maintaining Class I, H and III power boats.

Generally described, the present invention comprises a boat hull cleaning device having an elongated, waterproof, flexible strap to which are attached a plurality of cleaning loops. The cleaning loops comprise flexible non-scratching abrasive scrubbing pads which are removably attached to the waterproof strap by anchor flaps. Buoyant support cushions are attached to the strap beneath each removable scrubbing pad, such that the support cushions are sandwiched between the strap and a scrubbing pad. The optimum number of cleaning loops per strap and the distance between each cleaning loop are dependent on the maximum width of the hull. The ends of the strap are tapered to accommodate handles.

The method of the present invention comprises placing the device beneath the boat hull so that the scrubbing pads contact the submerged portion of the hull and so that the centerline of the device lines up with the seam of the hull. Then, using the handles on either end of the strap, the strap is manually drawn back and forth along the bottom and sides of the hull, in this manner "scrubbing" the marine growth from the boat's submerged bottom.

Thus, it is an object of the present invention to provide a device which efficiently cleans the submerged portion of a boat hull while allowing the operator to remain on board and the boat to remain afloat.

It is another object of the present invention to provide a hull cleaning device which is effective and easy to use.

It is a further object of the present invention to provide a hull cleaning device which is compact and light weight and easily stored aboard a vessel.

It is a further object of the present invention to provide a hull cleaning device which can be easily adapted for different types of fouling agents and/or hull surfaces.

It is a further object of the present invention to provide a hull cleaning device which will remove fouling agents from a boat hull without damaging the surface finish.

It is a further object of the present invention to provide a hull cleaning device which may be replaced in sections as particular sections of the device become worn.

In summary form, it is an object of the present invention to provide a portable, stowable hull cleaning device which occupies little of the normally scarce storage space in a recreational craft, which device can easily be used by two people of average strength, will effectively clean the hull of a boat, and has inexpensive easily replaceable working surfaces.

Other objects, features and advantages of the invention will become apparent upon review of the following detailed description of the preferred embodiments and the appended drawings.

BRIEF DESCRIPTION OF THE DRAWINGS

FIG. 1 shows a top plan view of a first embodiment of the present invention.

FIG. 2 is a perspective view of a section of a first embodiment of the present invention.

FIG. 3 is an exploded view of a first embodiment of one cleaning loop of the present invention.

FIG. 4 is a sectional view of a boat hull with a first embodiment of the present invention in use.

FIG. 5 is an enlarged detail of the segment defined as A—A in FIG. 4.

FIG. 6 is a perspective view of a handle of the present invention.

DETAILED DESCRIPTION OF THE INVENTION

Figure 8:
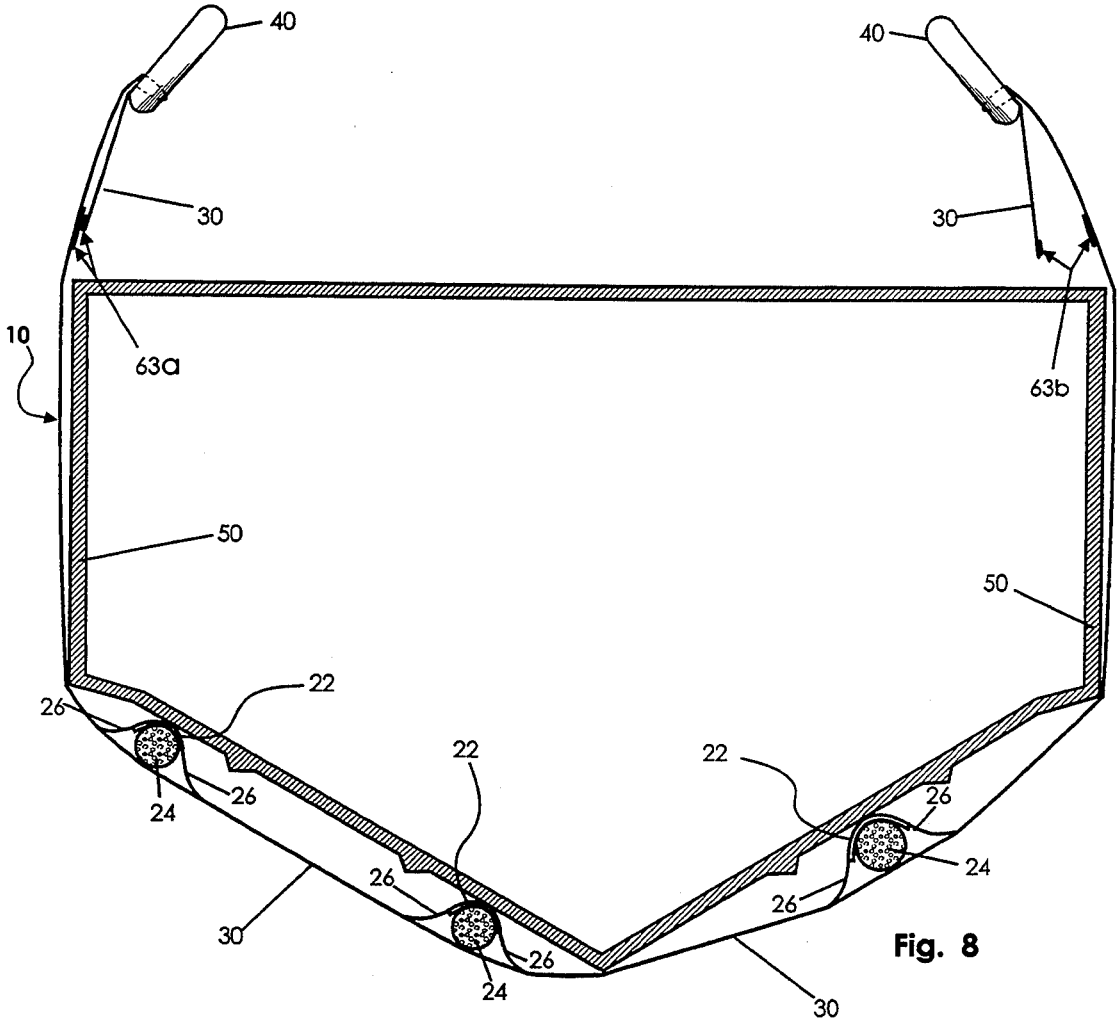
FIG. 8 is a sectional view of a boat hull with a second embodiment of the present invention in use.

Referring now in more detail to the drawings, in which like numbers refer to like elements throughout the several views, FIG. 1 shows a top plan view of the first preferred embodiment of a hull cleaning device 10 comprising a strap 30 having a plurality of cleaning loops 20*a*, 20*b*, 20*c*, and 20*d* attached thereto. In a first preferred embodiment, the cleaning loops 20*a–d* are equally sized and are positioned transversely on the upper surface of the strap 30 equidistance from either side of the center line CL of the strap 30. The hull cleaning apparatus 10 has two handles 40*a* and 40*b* attached to either end of the strap 30.

As described in more detail hereinbelow, the preferred material for embodying the strap 30 is a woven medium weight nylon with a smooth finish. However, the strap 30 of the present invention may be constructed with virtually any flexible non-water soluble material of sufficient strength since its principle function is to act as a carrier for the cleaning loops 20*a–d*. It is preferable to use a material such as nylon which is resistant to rot in both fresh and salt water environments and which can be finished to a smooth surface which will have a low coefficient of friction when in contact with a gel coat or marine grade varnish so as not to impede the use of the device 10 or to visibly mark the portion of the hull 50 above the water line with which it comes in contact.

Referring now in more detail to the individual elements of the present invention, as best seen in FIGS. 3 and 5, each cleaning loop 20 comprises a flexible, non-scratching abrasive scrubbing pad 22 removably attached to two anchor flaps 26. The texture and composition of the scrubbing pad 22 will vary depending on the marine environment in which the boat is kept and the extent to which bottom growth has developed. In cases of severe algae buildup or where algae was permitted to harden out of the water, the scrubbing pad 22 may be replaced with a more aggressive grade of cleaning pad. The scrubbing pad 22 can be made of synthetic or natural materials, or an admixture of both. For example, the scrubbing pad 22 can be constructed from thermal polyethylene. Alternatively, the polyethylene can be admixed with a natural fiber such as hogs hair to make a stiffer scrubbing pad 22 suitable for heavier marine growth and harder hull 50 finishes. A preferred material for use in the present invention is 100D Polythermal Floor Maintenance Pads manufactured by Microtron Abrasives, Inc. of Pineville, N.C. 100D Polythermal Floor Maintenance Pads are comprised of polyethylene, are of medium stiffness, and are suitable for use on a wide range of finishes and in a variety of marine environments.

Figure 9:
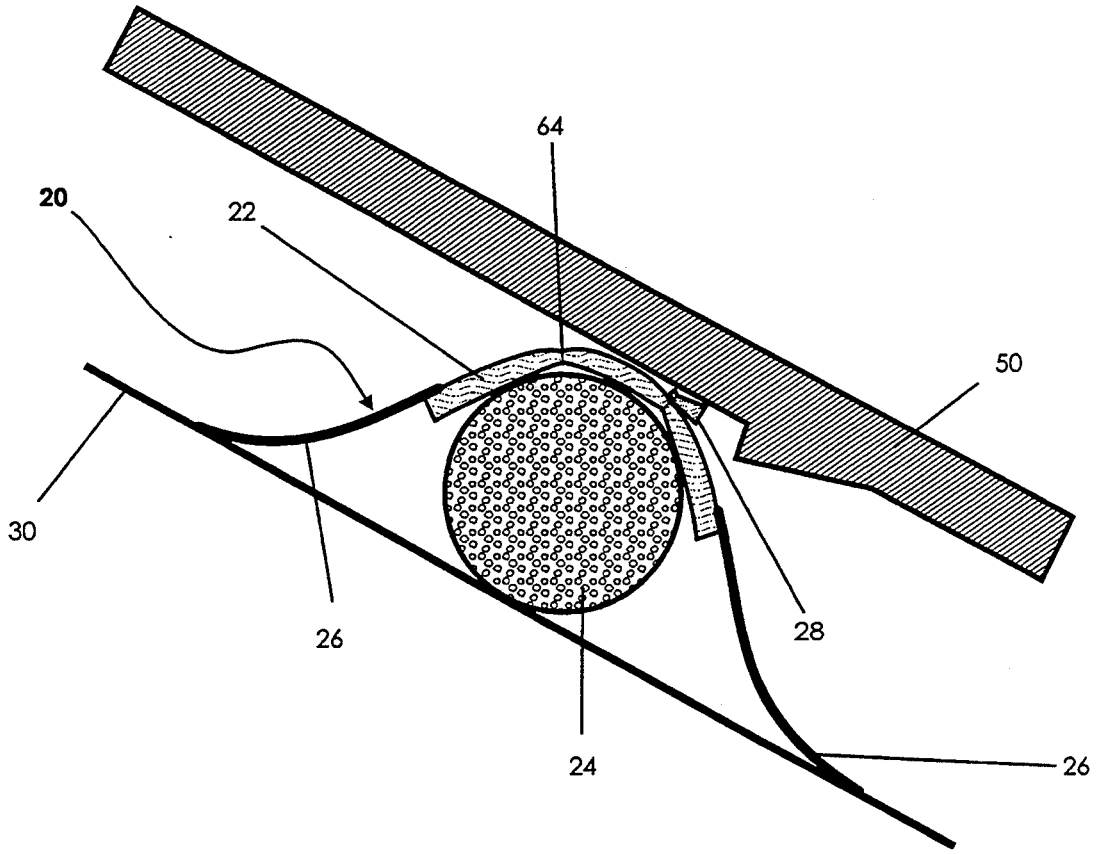
FIG. 9 is a sectional view of a second embodiment of the scrubbing pad of the present invention in use.

For particularly heavy marine growth and to improve the ability to clean the chines on a hull, the scrubbing pad 22 may be further modified by including protrusions on the pad surface, as depicted in FIG. 9. The protrusions can be formed in any convenient manner, however, the preferred method is to sew a flap 28 to the outer surface of the scrubbing pad 22 just to the right of the center line of the scrubbing pad 22. The flap 28 can be made from the same material as the scrubbing pad 22. Not only does this flap 28 provide a rougher cleaning surface, it also makes it possible to thoroughly clean the chines. To counteract the bend which forms in the scrubbing pad 22 at the point where the flap 28 is sewn to its outer surface, a second stitch line 64 can be made through the scrubbing pad 22 an equal distance from and on the opposite side of the center line of the scrubbing pad 22.

Figure 11:
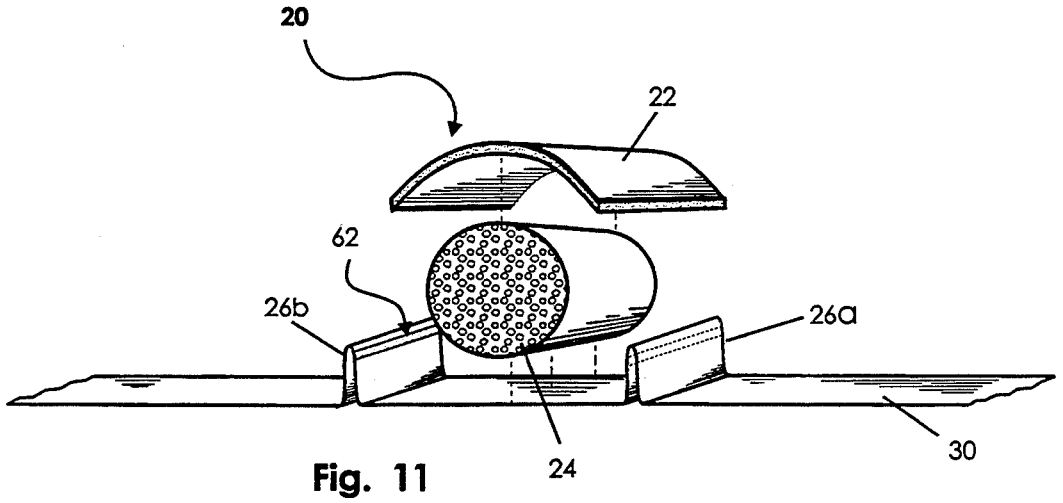
FIG. 11 is an exploded view of a second embodiment of one cleaning loop of the present invention.

As shown in FIG. 3, the scrubbing pad 22 is rectangular and is aligned with its length placed perpendicular to the length of the strap 30. One end of each anchor flap 26 is removably attached to the upper surface of the scrubbing pad 22 while the opposite end of each anchor flap 26 is attached to the strap 30 so as to make a slack loop, as shown in FIG. 5. The anchor flap 26 may be removably attached to the scrubbing pad 22 by any suitable mechanical means. The preferred method for attaching the anchor flap 26 to the scrubbing pad 22 is with high strength hook and loop fasteners such as that sold under the trademark VELCRO TM available from Velcro U.S.A. of Manchester, N.H. As depicted in FIG. 11, the fasteners 62 are attached to the undersurface of the anchor flaps 26*a–b*. The anchor flap 26 may be attached to the strap 30 by any permanent mechanical or chemical means or may actually be formed from the strap itself. For example, in a preferred embodiment of the present invention, the anchor flap 26 is made by folding the strap 30 onto itself so as to make a slack loop, and then stitching that loop together to make an anchor flap 26*a*, as depicted in FIG. 11. The anchor flap 26 may also be sewn onto the strap 30 or it may be chemically bonded.

The cleaning loop 20 has enough slack in the loop 20 to accommodate a buoyant support cushion 24, as shown in FIGS. 3 and 5. The support cushion 24 is formed of firm but deformable loam, or a similar deformable buoyant material. In a preferred embodiment of the present invention the support cushion 24 is composed of extruded polyethylene foam having a density of no more than two pounds per square inch and is formed in the shape of a cylinder. As shown in FIG. 3, each support cushion 24 is of the same length as the scrubbing pad 22 and of the same width as the strap 30. The support cushion 24 is permanently attached to the strap 30 by mechanical or chemical means as, for example, with nylon push pin fasteners. However, the support cushion 24 is not attached to the scrubbing pad 22.

Figure 10:
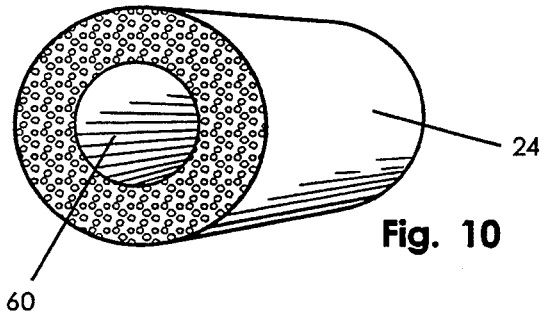
FIG. 10 is a perspective view of a second embodiment of the support cushion of the present invention.

As shown in FIG. 3, the support cushion 24 is preferably cylindrical but may be of virtually any shape such that the deformable material from which it is made will elevate the cleaning pad 22 above the surface of strap 30 when in use. It is much preferred, but not essential, to employ a shape which has an arcuate surface which contacts the back of cleaning pad 22 irrespective of the geometry of the sides of the cushion which are in the space between the anchor flaps 26 and adjacent strap 30. As the support cushion 24 becomes larger, its deformability is reduced. To preserve the deformability of the support cushion 24 a core through the center of the support cushion 24 can be extruded, defining an opening 60 through its center, as depicted in FIG. 10. This makes it possible to flex the firm polyethylene support cushion 24 when it contacts the hull surface 50. As seen in FIG. 1, the ends of the strap 30 are tapered to accommodate handles 40*a* and 40*b*, each of which defines an opening 42 wide enough to accommodate two normal sized adult hands. The strap 30 is threaded through two slots 44*a* and 44*b* in the handle, as shown in FIG. 6, and is maintained at a desired length by mechanical means. The preferred method for attaching the strap 30 to the handles 40*a* and 40*b* is to attach a mechanical fastener 63*a–b*, such as a hook and loop fastener, to the strap 30 so that the end of the strap 30 can be looped through the two slots 44*a* and 44*b* and then attached onto itself, as depicted in FIGS. 4 and 8. A variety of mechanical fasteners 63*a–b* can be used. The preferred mechanical fastener 63*a–b* is Velcro TM, available from Velcro, U.S.A. in Manchester, N.H. The handles 40 can be constructed from injection molded high strength plastic, nylon, polypropylene, wood or any other suitable rigid material.

The method of use of the present invention comprises placing the cleaning device 10 beneath a boat hull 50 such that the abrasive scrubbing pads 22 contact the submerged portion of the hull (see FIG. 5) 50 and so that the centerline CL of the cleaning device 10 lines up with the center of the boat hull 50 as shown in FIGS. 4 and 8. The handles 40 on the ends of the strap 30 project out of the water on opposite sides of the boat. The operators position the cleaning device 10 beneath the hull 50 by lowering the device into the water from the bow of the boat while holding the handles 40 and slowly working the cleaning device 10 aft. To clean the hull 50, the strap 30 is manually drawn back and forth across the undersurface of the boat hull 50, using the handles 40 while maintaining a light to moderate tension along its length. This back and forth cleaning stroke is repeated while slowly moving aft. When the first operator pulls on the strap, the second operator should relax the tension in their end of the strap, allowing the strap to be drawn across the hull. There is no need to apply tension from both ends of the device 10. When the length of the boat has been passed over once, the device is removed or the cleaning may be repeated by moving slowly toward the bow while again pulling the strap in a back and forth motion.

Because the abrasive scrubbing pads 22 only contact the surface of the hull 50 at intermittent points, the amount of resistance to the cleaning stroke is light. This results in a cleaning device that has a very easy pull. For example, five pound pull on one end of the cleaning device 10 illustrated in FIG. 4 is enough to create the desired amount of tension in the strap 30. The preferred fabric for use for the strap 30 is a medium weight nylon, #440 Denier distributed by Trident Products of Tamarach, Fla., with a very smooth finish. This smooth finish allows the strap 30 to slide easily over the sides of the boat when it comes into contact with the hull 50. This is particularly beneficial when using the cleaning device 10 from the deck of a boat where the strap 30 wraps around the upper parts of the hull 50. Using this material for the strap 30, the device is light weight and easy to use so that it can be used from the dock, from the deck of a boat or from a combination of the two.

It will thus be appreciated that in accordance with the method of the present invention, use of a flexible scrubbing pad 22 and a buoyant deformable support cushion 24 combined with light tension along the length of the strap 30, will force the curved surface of the scrubbing pad 22 into contact with all surfaces of the hull 50. The curved shape and the aggressive nature of the scrubbing pad 22 surface require that only a moderate amount of tension be applied to the strap 30 in order to achieve the required cleaning pressure.

The length of the cleaning stroke needed to clean the entire surface of a huh varies with the beam (greatest width) of the vessel and the positioning of the cleaning loops 20 on the strap 30. The length of the cleaning stroke should be enough to move the cleaning loops 20 over the entire surface of the hull in one or two passes. The cleaning loops 20 can be positioned to compensate for a wider beam. For example, if the device 10 has four cleaning loops 20 spaced equally along the length of the strap 30, as depicted in FIG. 1, on a medium sized boat with a beam of 8 to 10 feet, a cleaning stroke of approximately 24" to 30" is required. However, as the size of the boat hull approaches the 14 foot beam width, the cleaning stroke becomes an uncomfortable 40" if the same arrangement of cleaning loops is used.

Figure 7:
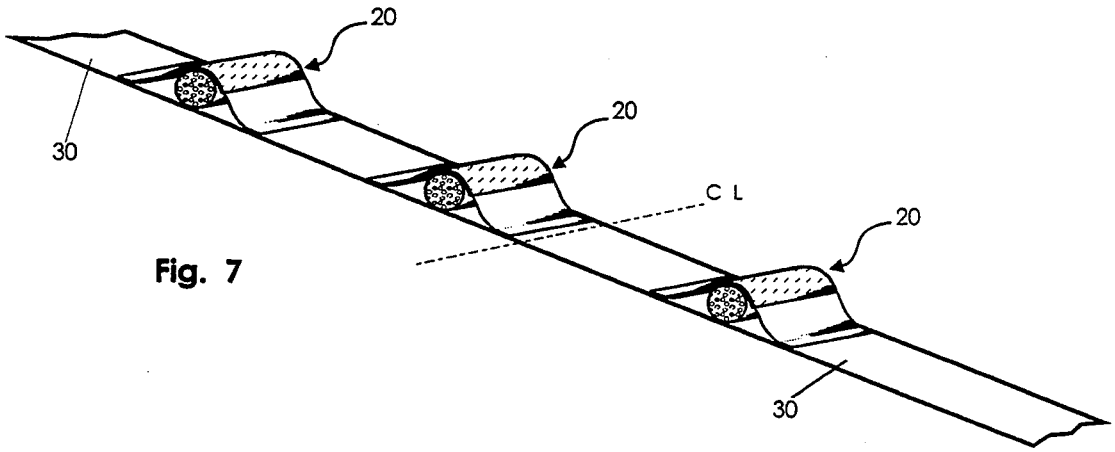
FIG. 7 is a perspective view of a section of a second embodiment of the present invention.

In a preferred embodiment of the present invention, four cleaning loops are aligned symmetrically on either side of a centerline which is aligned with the seam of the hull 50. Each cleaning loop 20 is responsible for cleaning ½ of the dead rise. For a wider hull, an asymmetrical arrangement shown in FIGS. 7 and 8 is preferred in which one cleaning loop 20, is located centrally on one side of the strap 30 centerline CL and two cleaning loops 20 are equally spaced by thirds, on the other side of the centerline CL. Each loop 20 then cleans only ⅓ of the hull side that it is on. The entire hull surface is cleaned by making one complete cleaning pass with the device 10 and then swapping the left and right sides and making another complete cleaning pass. Because the device 10 has an asymmetrical arrangement, each pass cleans ⅓ of one hull side and ⅔s of the other hull side. Although two complete passes are required to clean the entire hull surface, the resulting cleaning stroke for a 14 foot beam boat is a comfortable 28" instead of 40".

From the foregoing description of alternate preferred embodiments, it will be appreciated that the present invention overcomes the drawbacks of the prior art and indeed meets the above recited objects of the invention. The disclosed embodiments provide apparatus that are relatively easy to use by two adults, either men or women and useful for regular bottom cleaning of recreational boats while afloat in the water. They do not require the user to enter the water and encounter dangerous situations such as tidal currents or swimming in an area between a boat hull and dock structures. Furthermore, the apparatus may be easily folded and takes up a very small amount of space, determined principally by the size of the deformable float supports and the bulk of the strap. It may be conveniently stowed on board, is easy to use, has readily replaceable working surfaces, and is easy to position in the water without requiring the user to work against the buoyancy of devices designed to urge a cleaning surface against a hull. The present inventors believes that the disclosed physical embodiments and the methods described herein are the best modes of carrying out their invention at this time.

While this invention has been described in detail with particular reference to preferred embodiments thereof, it will be understood that variations and modifications can be effected within the spirit and scope of the invention as described herein before and as defined in the appended claims.

What is claimed is:

1. A boat hull cleaning device comprising:

an elongated strap extending between a pair of longitudinally spaced apart ends having an upper surface;

a plurality of cleaning loops attached to and extending above said upper surface;

a plurality of support cushions attached to and extending above said upper surface and below said cleaning loop; wherein each of said plurality of support cushions comprises a deformable buoyant cylinder of a form having a diameter no greater than the distance between said elongated strap and said cleaning loop.

2. A boat hull cleaning device comprising in combination:

an elongated strap extending between a pair of longitudinally spaced apart ends and having an upper surface and a lower surface;

a plurality of cleaning loops disposed along said upper surface, each of said cleaning loops comprising a pair of spaced apart anchor flaps, each having a first flap end attached to said upper surface and a second flap end attached to a scrubbing pad, and a support cushion attached to said upper surface of said elongated strap under said scrubbing pad.

3. The device of claim 2 wherein said elongated strap is tapered at said longitudinally spaced apart ends.

4. The device of claim 2 wherein said elongated strap is composed of a lightweight flexible, waterproof material.

5. The device of claim 4 wherein said material is nylon.

6. A boat hull cleaning device as recited in claim 2 further comprising:

a pair of handles, each of said pair of handles being attached to one of said pair of longitudinally spaced apart ends.

7. A boat hull cleaning device as recited in claim 6 wherein each of said pair of handles is selectively removable from said longitudinally spaced apart ends.

8. A boat hull cleaning device as recited in claim 2 wherein said second flap end is removably attached to said scrubbing pad.

9. The device of claim 8 wherein said scrubbing pad is rectangular.

10. The boat hull cleaning device of claim 2 wherein said scrubbing pad further comprises a top surface and a bottom surface to which said top surface, along the width of said scrubbing pad, is attached a protrusion.

11. The device of claim 2 wherein said scrubbing pad comprises a non-scratching abrasive material.

12. The device of claim 11 wherein said non-scratching abrasive material is polyethylene.

13. A boat hull cleaning device as recited in claim 2 wherein said support cushion is cylindrical.

14. The device of claim 13 wherein said cylindrical support cushion has a diameter no greater than the distance between said scrubbing pad and said strap when said cleaning loop is engaged.

15. A boat hull cleaning device as recited in claim 2 wherein said support cushion includes an arcuate surface proximate to and urged against said scrubbing pad.

16. A boat hull cleaning device comprising in combination:

an elongated strap extending between a pair of longitudinally spaced apart ends and having an upper surface and a lower surface;

a plurality of cleaning loops attached to and extending above said upper surface of said elongated strap, and a support cushion attached to said upper surface of said elongated strap and disposed between each of said plurality of cleaning loops and said elongated strap, wherein each of said plurality of cleaning loops comprises a selectively detachable scrubbing pad located substantially at the center of said cleaning loop attached to said elongated strap by a pair of anchor flaps.

17. The device of claim 16 wherein said scrubbing pad is rectangular.

18. The device of claim 16 wherein said scrubbing pad further comprises a protrusion projecting therefrom.

19. The device of claim 16 wherein said scrubbing pad comprises a non-scratching abrasive material.

20. The device of claim 16 wherein said on-scratching abrasive material is polyethylene.

21. The device of claim 16 wherein said support cushion further comprises a buoyant cylinder.

* * * * *